US011988222B2

(12) United States Patent
Li et al.

(10) Patent No.: US 11,988,222 B2
(45) Date of Patent: May 21, 2024

(54) FLEXIBLE GUIDE VANE STRUCTURE OF MIXED FLOW PUMP WITH ADJUSTABLE FLOW AREA, MIXED FLOW PUMP AND ADJUSTMENT METHOD

(71) Applicant: JIANGSU UNIVERSITY, Zhenjiang (CN)

(72) Inventors: Wei Li, Zhenjiang (CN); Leilei Ji, Zhenjiang (CN); Dong Liu, Zhenjiang (CN); Dele Lu, Zhenjiang (CN); Shuo Li, Zhenjiang (CN); Yi Yang, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 17/791,230

(22) PCT Filed: Jul. 16, 2021

(86) PCT No.: PCT/CN2021/106644
§ 371 (c)(1),
(2) Date: Jul. 7, 2022

(87) PCT Pub. No.: WO2022/241937
PCT Pub. Date: Nov. 24, 2022

(65) Prior Publication Data

US 2024/0044339 A1 Feb. 8, 2024

(30) Foreign Application Priority Data

May 20, 2021 (CN) ..... 202110553368.0

(51) Int. Cl.
*F04D 29/30* (2006.01)
*F04D 29/46* (2006.01)

(52) U.S. Cl.
CPC ..... *F04D 29/305* (2013.01); *F04D 29/46* (2013.01)

(58) Field of Classification Search
CPC ..... F04D 29/305; F04D 29/46; F04D 29/462; F04D 29/464
See application file for complete search history.

(56) References Cited

FOREIGN PATENT DOCUMENTS

CN 106499669 A 3/2017
CN 110173460 A 8/2019
(Continued)

OTHER PUBLICATIONS

Fengming Yi, Adjustment of flexible guide vanes for mine local fan, 1991, pp. 5-7,64, No. 12.

*Primary Examiner* — Brian O Peters
(74) *Attorney, Agent, or Firm* — Bayramoglu Law Offices LLC

(57) ABSTRACT

A flexible guide vane structure of a mixed flow pump with adjustable flow area, a mixed flow pump and an adjustment method are provided. The flexible guide vane structure includes a flexible guide vane and a flexible guide vane adjusting device. The flexible guide vane adjusting device includes a support rib, a support rib base and a base driving mechanism. As the skeleton of the flexible guide vane, the support rib realizes the shape change of the flexible vane through the base driving mechanism and the support rib base. In the mixed flow pump, the flexible guide vane adjusting device is installed inside the blade hub. Through the flow section feedback regulation system, the angle of the support rib is adjusted based on the real-time working condition of the mixed flow pump to adjust the flow area of the blade and achieve the best working condition.

9 Claims, 7 Drawing Sheets

(56) References Cited

FOREIGN PATENT DOCUMENTS

| | | | |
|---|---|---|---|
| DE | 102005019896 | A1 | 11/2006 |
| GB | 921952 | A | 3/1963 |
| JP | 2007291888 | A | 11/2007 |

FLEXIBLE GUIDE VANE STRUCTURE OF MIXED FLOW PUMP WITH ADJUSTABLE FLOW AREA, MIXED FLOW PUMP AND ADJUSTMENT METHOD

CROSS REFERENCE TO THE RELATED APPLICATIONS

This application is the national phase entry of International Application No. PCT/CN2021/106644, filed on Jul. 16, 2021, which is based upon and claims priority to Chinese Patent Application No. 202110553368.0, filed on May 20, 2021, the entire contents of which are incorporated herein by reference.

TECHNICAL FIELD

The present invention belongs to the technical field of internal flow of fluid machinery (pump), it relates in particular to a flexible guide vane structure of a mixed flow pump with adjustable flow area, a mixed flow pump and an adjustment method.

BACKGROUND

Mixed flow pump is more and more used in industrial and agricultural production because of its large flow rate and moderate head, as the power equipment in the fields of sewage treatment, mining, power generation, flood control and drainage. However, the design theory of mixed flow pump is not perfect at present, and it is always designed based on the rated flow operating point, which can't meet the demand of multi operating points, wide efficient areas in industrial and agricultural production. In particular, for the mixed flow pump structure designed by using the classical design theory, when its flow rate is reduced to a certain value, the rotating stall effect often occurs in the pump, resulting in a sharp decline in head and synchronous reduction in efficiency. In some cases, the mixed flow pump unit will have abnormal vibration, which seriously threatens the safe operation of the unit. The root cause is that due to the reduction of flow conditions, the flow area of impeller or guide vane originally designed based on rated flow conditions has been much larger than that required by the fluid at the current flow rate. Therefore, part of the low momentum fluid occupies the local space in the impeller or guide vane channel for a long time, forming a variety of complex vortex structures, while other parts of the fluid in the channel can pass smoothly. At present, some improvement measures have been taken to improve the formation of stall in the impeller of mixed flow pump, but there is no relevant report to improve the stall in the guide vane of mixed flow pump through technical means.

SUMMARY

Aiming at the shortcomings in the existing technology, the present invention proposes a flexible guide vane structure, a mixed flow pump and an adjustment method of a mixed flow pump with adjustable flow area, which improves the performance efficiency of the mixed flow pump by adjusting the flow area of the guide vane in the operation process of the mixed flow pump in real time, thus realizing the operation of the mixed flow pump in a wide and efficient area, and widening the application scenes of the mixed flow pump.

A flexible guide vane structure of mixed flow pump with adjustable flow area, the flexible guide vane structure includes in flexible guide vanes, flexible guide vane adjusting device. The flexible guide vane adjusting device includes in groups of support ribs, n support rib bases, n groups of base driving mechanisms, and the number of support ribs in each group is n; one end of each support rib in the m groups of support ribs is fixedly installed on a support rib base, where m is a positive integer greater than 2 and n is a positive integer greater than 5; the flexible guide vane is fixedly installed on the support rib, and each support rib base is driven by a group of base driving mechanisms, so as to drive the support rib to rotate; the support rib base is driven by different base driving mechanisms to rotate at different angles; thus, the shape of the flexible guide vane is changed.

Further, the inner ring of the support rib base is provided with an internal gear, the base driving mechanism includes a servo motor an external gear, the outer gear is installed on the output shaft of the servo motor, and meshing with the internal gear on the support rib base.

The mixed flow pump with adjustable flow area having the flexible guide vane structure, the mixed flow pump includes impeller hub, impeller, guide vanes, flexible guide vane structure and flow section feedback regulation system, the regulating devices of the guide vane and the flexible guide vane are installed behind the impeller outlet, a flexible guide vane is correspondingly installed behind the suction surface of each guide vane.

Further, the inner part of the guide vane hub is provided with an annular groove, and n long strip-shaped hollow grooves are arranged at the root of each guide vane, extending along the circumferential direction on the annular wall between the annular groove and the guide vane hub surface; the support rib base is annular, n support rib bases are arranged and sleeved in the annular groove in turn, the support rib with one end fixed on the support rib base extends through the long strip-shaped hollow grooves; the flexible guide vane is fixedly installed on the support rib; the driving mechanism of the support rib base is installed in the gap in the support rib base and the annular groove of the wheel hub; flow section feedback regulation system includes a flow condition detection device of the mixed flow pump connected by communication, a support rib angle adjustment module which is also connected with the driving mechanism of the support rib base and regulates the work of the driving mechanism of the support rib base based on the real-time flow, head, efficiency and power of the mixed flow pump to adjust the shape of the flexible guide vane in order to change the flow area of guide vane channel to adapt to the current flow condition, so as to improve the efficiency of mixed flow pump.

Further, the support rib is bent after being installed on the support rib base, as the root of the support rib is close to the guide vane, its shape is the same as that of the suction surface of the guide vane, so that the flexible guide vane and the suction surface of the blade fit each other; after bending, the height of the support rib extending out of the guide vane hub shall not exceed the height of the guide vane.

Further, the cross section of the support rib is cylindrical, and the cross-section diameter is equal to the maximum thickness of the guide vane; the support rib is provided with a screw hole, the corresponding position of the flexible guide vane is provided with a through hole, and the flexible guide vane is fixed on the support rib by screws.

Further, a groove is arranged on the annular plane on the side of the support rib base, and the first roller is installed in the groove, which is in sliding contact between the first roller and the adjacent support rib base.

Further, multiple grooves are also arranged on the outer circumferential surface of the support rib base, and the second roller is installed inside, which is in rolling contact with the inner wall surface of the annular groove in the guide vane hub.

Further, the number of the long strip-shaped hollow grooves is the same as that of each group of support ribs, and is evenly distributed along the direction from the inlet to the outlet of the guide vane; the maximum width of the long strip-shaped hollow groove is not more than twice the cross-sectional diameter of the support rib; the long strip-shaped hollow groove at the inlet end of the guide vane is the first long strip-shaped hollow groove, the minimum circumferential length of the first long strip-shaped hollow groove is 1.5 times the cross-sectional diameter of the support rib, and the maximum circumferential length is 3 times the cross-sectional diameter of the support rib; the minimum circumferential length of the long strip-shaped hollow groove between the first long strip-shaped hollow groove and the guide vane outlet is ½ of the width of a single guide vane channel, and the maximum circumferential length is 0.9 times the width of a single guide vane channel.

Further, the servo motor is fixed in a square groove inside the filling block; the filling block is located inside the support rib base, which is an annular cylindrical structure, and the adjacent filling blocks are in contact through an annular protrusion on one side; the support rib base and the filling block are fixed in the axial direction through the compression ring behind the guide vane; the compression ring is evenly provided with a second through hole along the circumferential direction for fixing by bolts; a third through hole is also arranged at the wire slot of the corresponding filling block on the compression ring so that the signal line and power line of the servo motor can pass through; the signal line and the power line can pass through the pump body and be connected to the external flow section feedback regulation system.

The method for adjusting the flow area of the mixed flow pump includes the following steps:

Step 1: Before the mixed flow pump officially starts working, each support rib needs to be adjusted to the position close to the suction surface of the guide vane, the angle of each servo motor is "zeroed", and then the support rib is adjusted to one end away from the long strip-shaped hollow groove and away from the guide vane, the current corresponding angle of each support rib (8) is recorded, which is the maximum rotation angle of each support rib;

Step 2: Carry out angle positioning test of support rib: Start the mixed flow pump and adjust the flow condition of the mixed flow pump. When the mixed flow pump operates stably under different flow conditions, the support rib angle adjustment module starts to drive the servo motor, slowly increase the rotation angle of the remaining support ribs, and record the maximum efficiency value of the mixed flow pump and the corresponding optimal angle of the support ribs into the database during the change of the angle of the support ribs; during the adjustment process, keep the angle of the support rib in the first long strip-shaped hollow groove at the inlet unchanged so that it is always close to the suction surface of the blade; during the rotation of other support ribs, the rotation angle of each support rib changes in proportion k along the flow direction until the last support rib has the maximum rotation angle, where k is a number greater than 1.

Step 3: After the mixed flow pump is officially operated and stable, the flow condition detection device of the mixed flow pump monitors the flow condition of the mixed flow pump in real time, and the angle adjustment module of the support rib adjusts the angle of each support rib according to the data in the database to adjust it to the optimal angle closest to the flow condition; thereafter, the angle adjustment module of the support rib fine adjusts within ±5° of the optimal angle, and obtains the maximum efficiency value of the mixed flow pump and the corresponding angle of each support rib; at the same time, record the data into the database in step 2, so that the mixed flow pump can be adjusted in time when it runs under this flow condition next time; If the mixed flow pump flow condition detection device detects the flow change of the mixed flow pump, carry out real-time fine adjustment according to step 3.

The beneficial effects of the present invention are as follows

A flexible guide vane structure of a mixed flow pump with adjustable flow area and a mixed flow pump. Without changing the original hydraulic design of the guide vane of the mixed flow pump, by adding the flexible guide vane adjusting device, the flow area of the guide vane channel can be adjusted in real time according to the current flow condition during the operation of the mixed flow pump, so as to optimize the flow field structure in the guide vane, improve the efficiency and broaden the high-efficiency area of the mixed flow pump.

Figure 1:
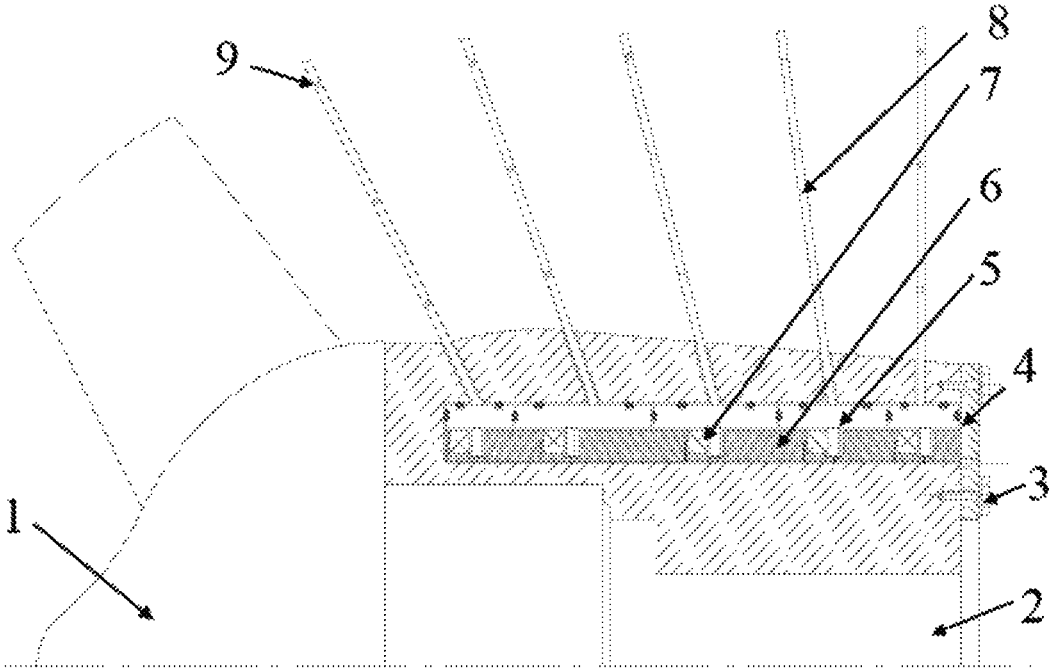
FIG. 1 shows a schematic diagram of the flexible guide vane structure of the mixed flow pump with adjustable flow area of the present invention.

In the figures: 1. Impeller, 2. guide vane hub, 3. bolt, 4. compression ring, 5. support rib base, 6. filler block, 7. servo motor, 8. support rib, 9. first threaded hole, 10. first roller, 11. guide vane, 121. first long hollow groove, 122. second long hollow groove, 123. third long hollow groove, 124 fourth long hollow groove, 125 fifth long hollow groove, 13. guide vane hub, 14. second roller, 15. second threaded hole, 16. internal gear, 17. flexible guide vane, 18. external gear, 19. slot, 20. square slot of servo motor, 21. first through hole, 22. hold down ring, 23. second through hole, 24. third through hole, 25. annular protrusion.

DETAILED DESCRIPTION OF THE EMBODIMENTS

The present invention will be further described below in combination with the accompanying drawings and specific embodiments, but the protection scope of the present invention is not limited to this.

A flexible guide vane structure of mixed flow pump with adjustable flow area, the structure includes m flexible guide vanes 17, flexible guide vane adjusting device. The flexible guide vane adjusting device includes m groups of support ribs 8, n support rib bases, n groups of base driving mechanisms, and the number of support ribs in each group is n; one end of each support rib in the m groups of support ribs is fixedly installed on a support rib base 5, where m is a positive integer greater than 2 and n is a positive integer greater than 5; the flexible guide vane 17 is fixedly installed on the support rib 8, a group of support ribs 8 is used as the skeleton of a flexible guide vane 17, and each support rib 8 in the same group of support ribs 8 is respectively installed on a support rib base 5, so as to realize the different orientation of the support rib 8 of the same flexible guide vane 17 and make the rotation flexibility of the flexible guide vane variable. Each support rib base 5 is driven by a group of base driving mechanisms, so as to drive the support rib 8 to rotate; the support rib base 5 is driven by different base driving mechanisms to rotate at different angles; thus, the shape of the flexible guide vane 17 is changed.

The inner ring of the support rib base 5 is provided with an internal gear 16, the base driving, mechanism includes a servo motor 7 and an external gear 18, the outer gear 18 is installed on the output shaft of the servo motor 7, and meshing with the internal gear 16 on the support rib base 5

Figure 2:
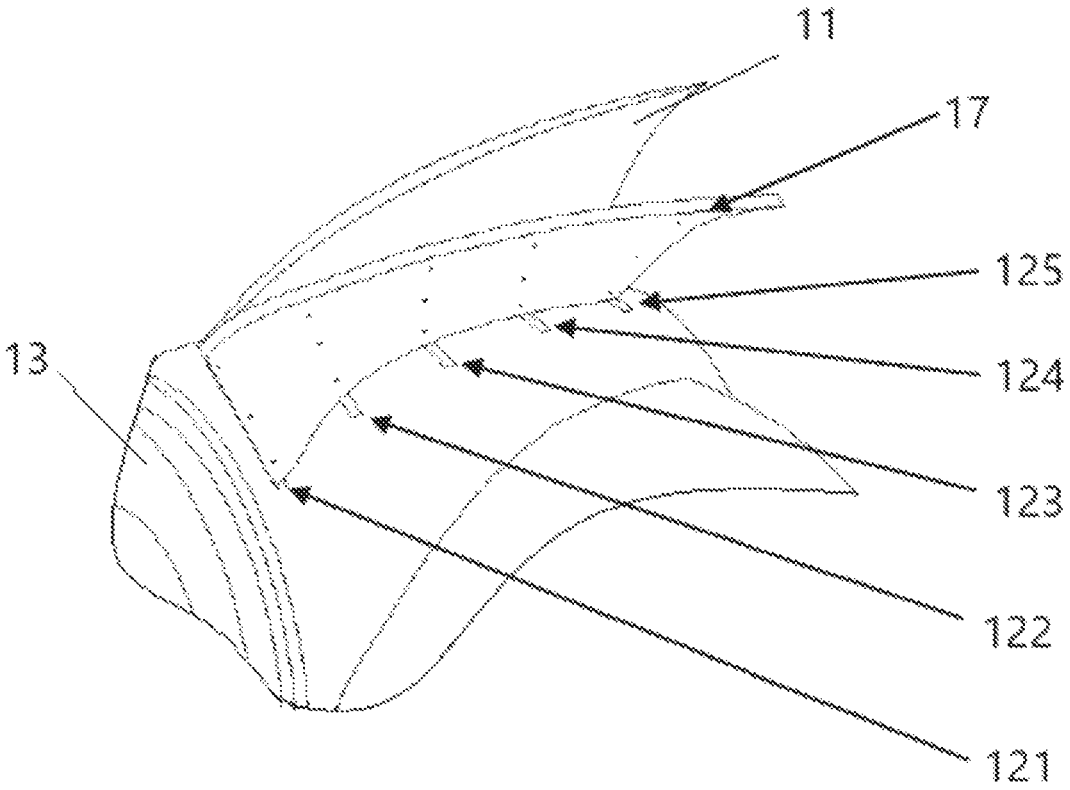
FIG. 2 shows a schematic diagram of the flexible guide vane.

The flexible guide vane structure of the mixed flow pump with adjustable flow area, as shown in FIGS. 1 and 2, includes impeller hub 2, impeller 1, guide vane 11, flexible guide vane structure and flow section feedback regulation system; the regulating devices of the guide vane 11 and the flexible guide vane 17 are installed behind the impeller outlet, a flexible guide vane 17 is correspondingly installed behind the suction surface of each guide vane 11

The inner part of the guide vane hub 13 is provided with an annular groove, and n long strip-shaped hollow grooves are arranged at the root of each guide vane extending along the circumferential direction on the annular wall between the annular groove and the guide vane hub surface, so that the support rib 8 of the flexible guide vane adjusting device extends. The flexible guide vane adjusting device is installed in the annular groove of the guide vane hub 2.

Figure 4:
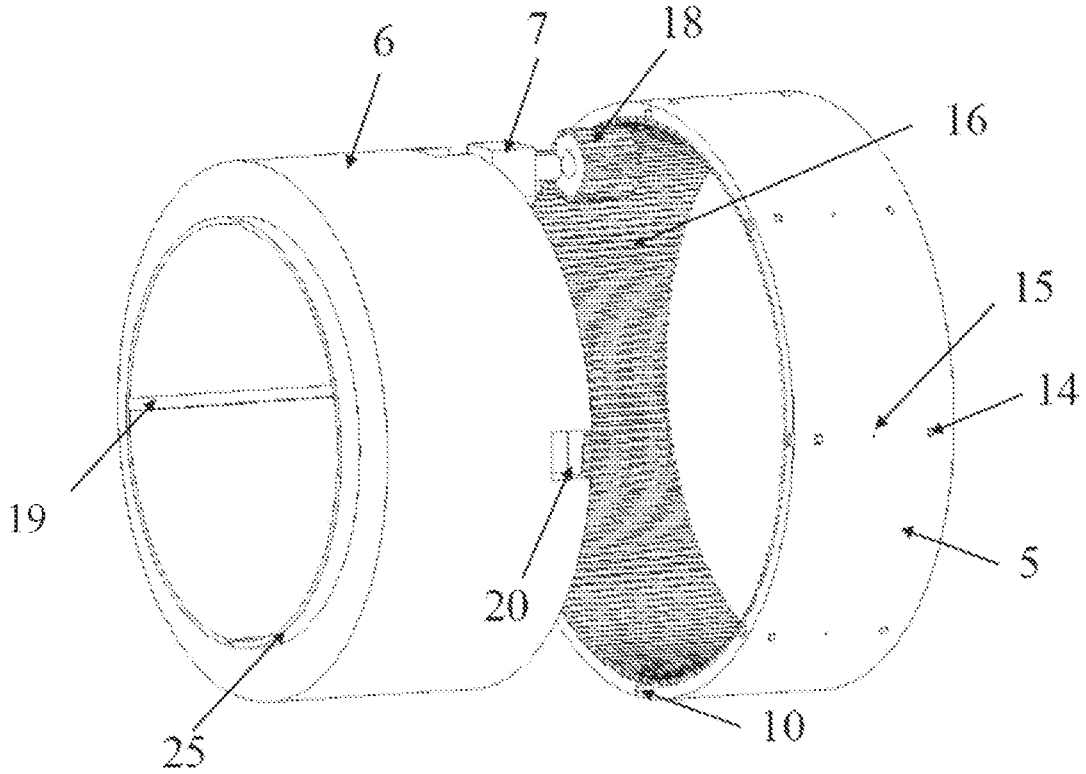
FIG. 4 shows the structure of the support rib base, servo motor, internal meshing gear and filling block.
Figure 5:
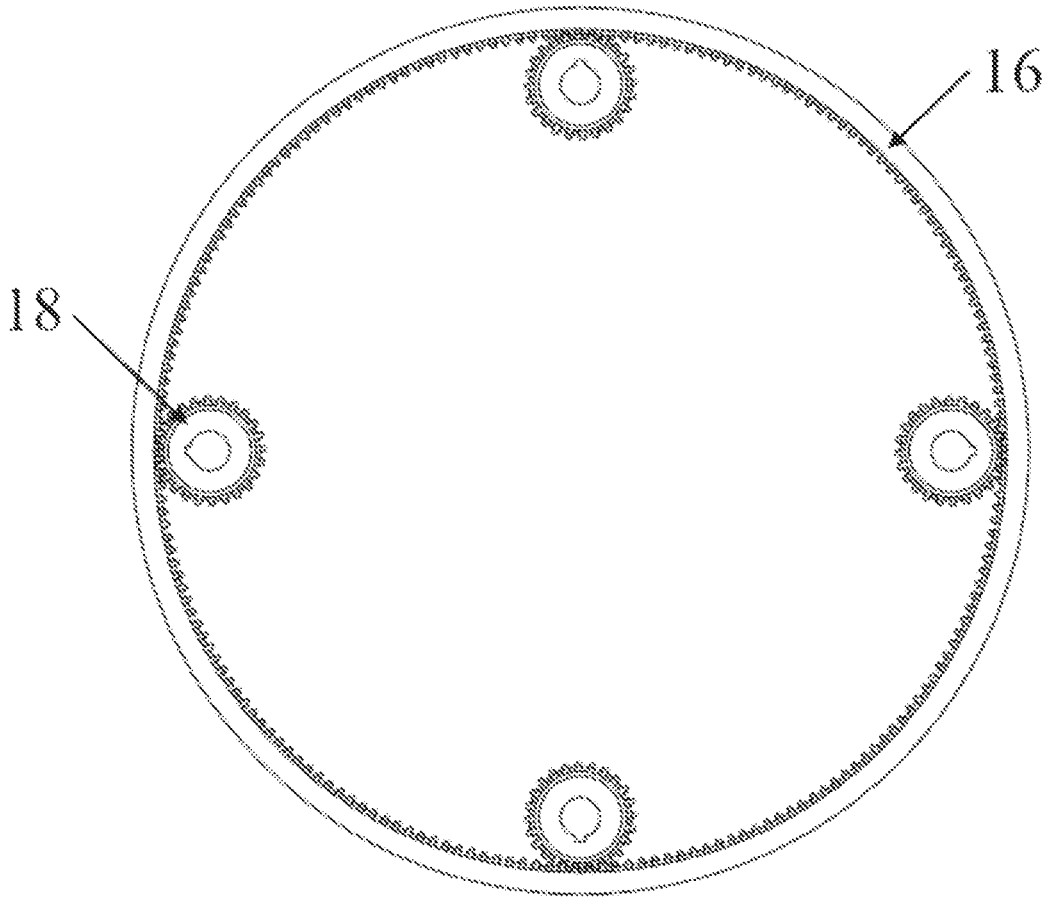
FIG. 5 shows the cross-sectional diagram of the support rib base and the internal meshing gear shaft.
Figure 6:
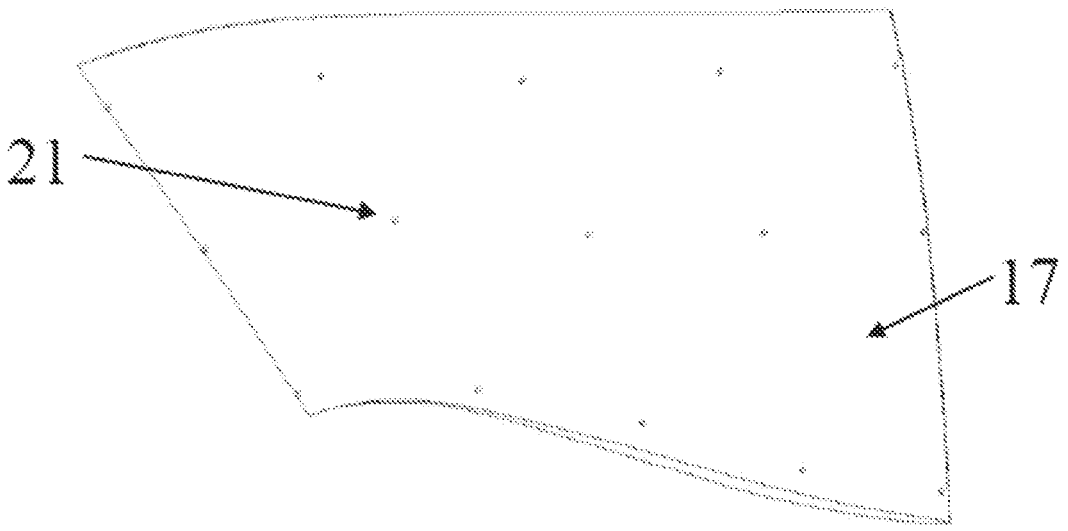
FIG. 6 shows a schematic diagram of the flexible guide vane.
Figure 7:
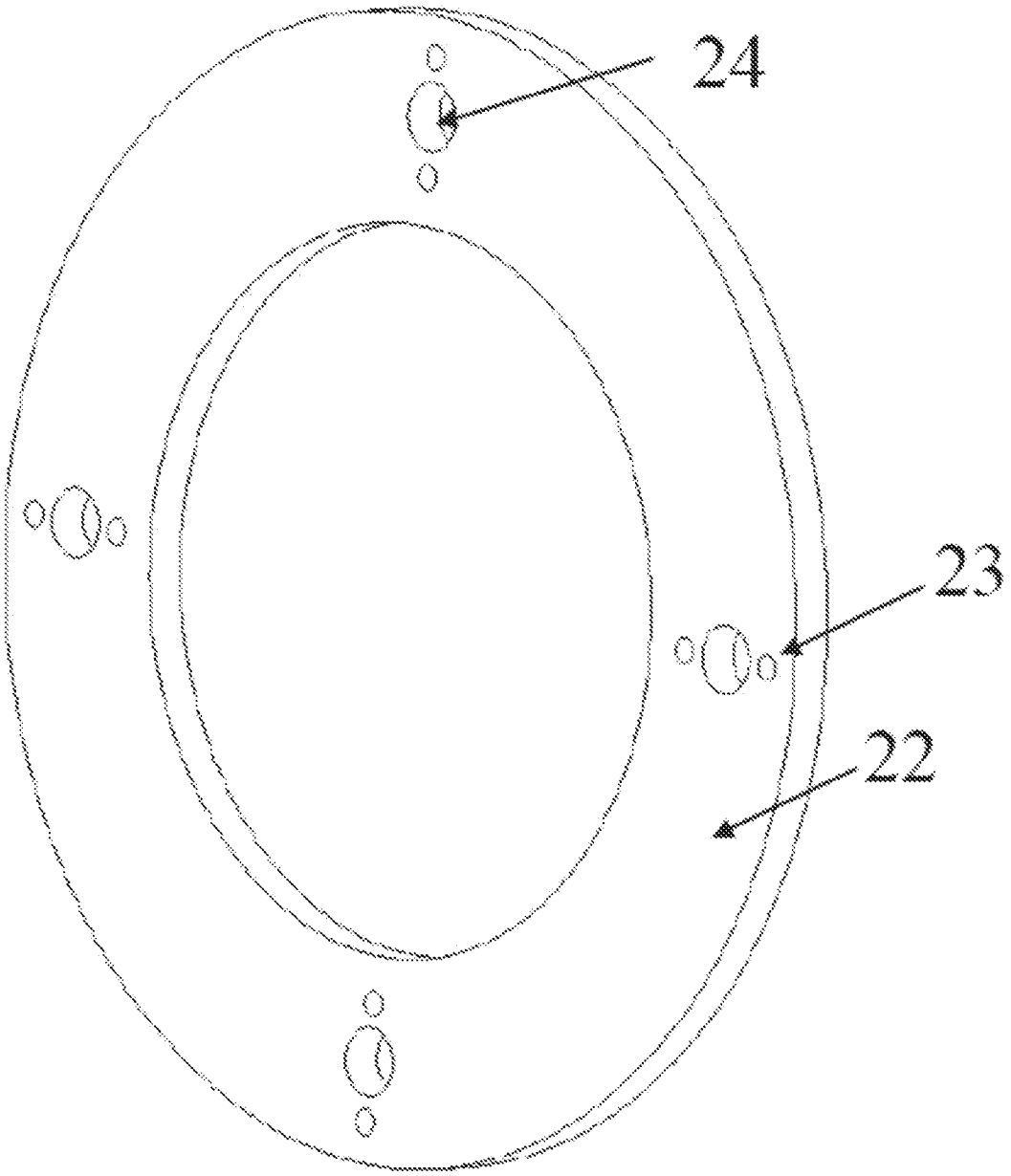
FIG. 7 shows a schematic diagram of the compression ring.

As shown in FIGS. 1, 4 and 5, the support rib base 5 is annular, and internal gear 16 is processed internally. N support rib bases 5 are arranged and sleeved in the annular groove in turn. The base driving mechanism includes a servo motor 7 and an external gear 18. The external gear 18 is installed on the output shaft of the servo motor 7 and meshes with the internal gear 16 on the support rib base 5 to drive the rotation of the support rib base 5 with the power of the servo motor 7. One end of the support rib 8 fixed on the support rib base 5 extends through the long strip-shaped hollow groove; The flexible guide vane 17 is fixedly installed on the support rib, as shown in FIG. 2.

Figure 3:
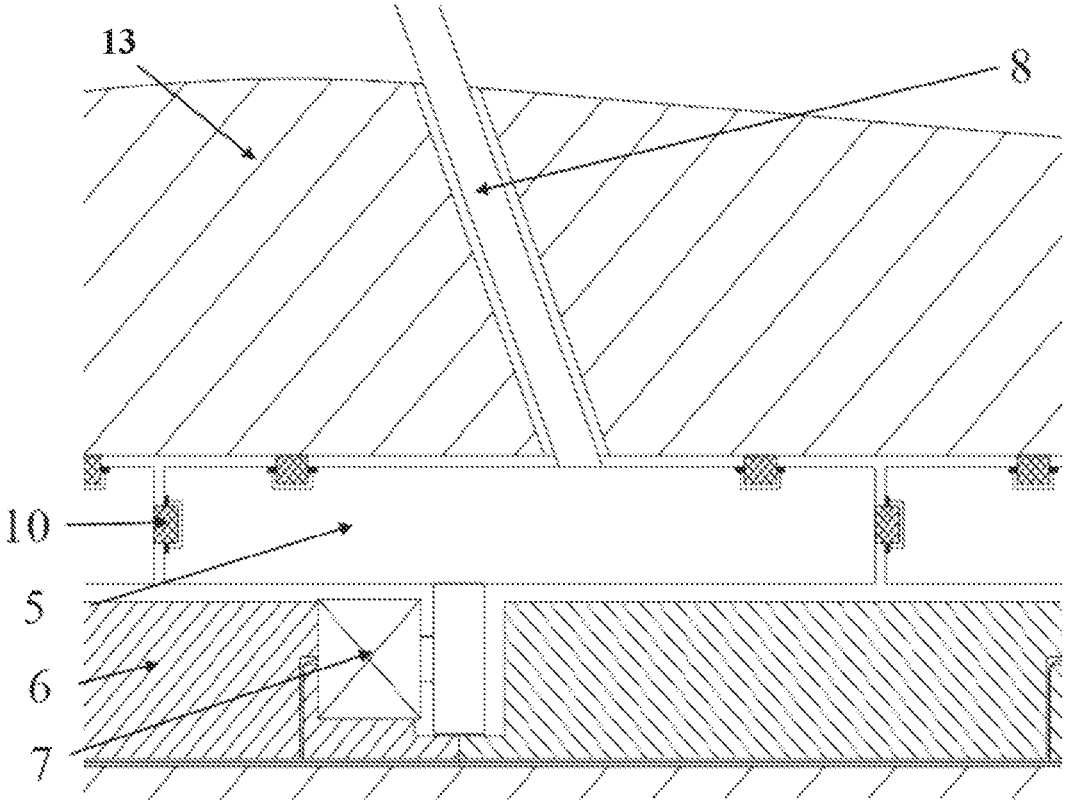
FIG. 3 shows an enlarged diagram of the flexible guide vane structure of the mixed flow pump with adjustable flow area of the present invention.

As shown in FIG. 3, the annular plane on one side of the support rib base 5 is provided with a groove, and the first roller 10 is installed in the groove. The other side of the support rib base 5 is an annular plane and serves as the support plane of the first roller 10 of the adjacent support rib base 5. The rolling contact between the adjacent support rib bases 5 reduces the friction of the two adjacent support rib bases 5. The outer circumferential surface of the support rib base 5 is also provided with a groove, and the second roller 14 is installed inside, which is in rolling contact with the inner wall surface of the annular groove in the guide vane hub 13, so that the support rib base 5 can rotate freely in the circumferential direction. The second roller 14 is at least two groups along the axis direction and is located on both sides of the support rib 8. The first roller 10 and the second roller 14 are evenly distributed along the circumferential direction, and the number of them in the circumferential direction is not less than 6. The outer surface of the support rib base 5 is also processed with a second threaded hole 15 for installing the support rib 8, and the axis direction of the second threaded hole 15 is consistent with the direction of the support rib 8. The support ribs 8 are installed on the support rib base 5 through threaded connection.

The support rib 8 of the flexible guide vane adjusting device is installed in the axial middle of the support rib base 5 through threaded connection, and each support rib 8 in the same group corresponds to the support rib base 5 one by one. The support ribs 8 are evenly distributed along the direction from the inlet to the outlet of the guide vane, and the number is at least 5. The cross section of the support rib 8 is circular, and the cross-section diameter is equal to the maximum thickness of the guide vane 11. Before installation, it is cylindrical. After the support rib 8 is installed on the support rib base 5 through threaded connection, it needs to be bent, and its linear shape is adjusted to be the same as the shape of the suction surface of the guide vane 11 at the position, which is that the flexible guide vane on it fits with the suction surface of the blade. After bending, the height of the support rib 8 extending out of the guide vane hub 13 does not exceed the height of the guide vane 11. The support rib 8 is wrapped with a flexible guide vane 17, the support rib 8 is also processed with a first threaded hole 9, the corresponding position of the flexible guide vane 17 is provided with a first through hole 21, and the flexible guide vane 17 is fixed with the support rib 8 by screws.

The number of the long strip-shaped hollow grooves is the same as the number n of the support rib 8, and n=5 in this embodiment. The hollow grooves are evenly distributed along the direction from the inlet to the outlet of the guide vane, which are successively marked as the first long strip-shaped hollow groove 121, the second long strip-shaped hollow groove 122, the third long strip-shaped hollow groove 123, the fourth long strip-shaped hollow groove 124 and the fifth long strip-shaped hollow groove 125. The maximum width of the long strip-shaped hollow groove 12 is not greater than twice the cross-sectional diameter of the support rib 8. The minimum circumferential length of the first long strip-shaped hollow groove 121 is 1.5 times the cross-sectional diameter of the support rib 8, and the maximum circumferential length is 3 times the cross-sectional diameter of the support rib 8. The minimum circumferential length of the second long strip hollow groove 122, the third long strip hollow groove 123, the fourth long strip hollow groove 124 and the fifth long strip hollow groove 125 is ½ of the width of a single guide vane channel, and the maximum circumferential length is 0.9 times the width of a single guide vane channel.

The support rib base 5 is adjusted by a servo motor 7 installed with an external gear 18, which is fixed in a square groove 20 inside the filling block 6. The filler block 6 is located between the support rib base 5 and the inner wall surface of the annular groove of the impeller hub 2. The servo motor 7 and the external gear 18 are evenly, distributed along the circumferential direction, and the number is equal and at least 4. The filling block 6 is internally processed with an internal wire hole and a wire slot 19 used for the power line and signal line of servo motor 7, and the number is the same as that of servo motor 7. The filling block 6 is located inside the support rib base 5, which is an annular cylindrical structure, and the adjacent filling blocks 6 are in contact through an annular protrusion 25 on one side. The support rib base 5 and the filler block 6 are fixed in the axial direction through the compression ring 22 behind the guide vane. The compression ring 22 is evenly provided with a second through hole 23 along the circumferential direction for fixing by bolts. A third through hole 24 is also arranged at the corresponding filling block slot 19 on the compression ring so that the signal line and power line of the servo motor 7 can pass through. The signal line and the power line can pass through the pump body and be connected to the external flow section feedback regulation system.

The flow condition detection device of the mixed flow pump and the support rib angle adjustment module are connected by the flow section feedback adjustment system. The support rib angle adjustment module is also connected with the support rib base driving mechanism, and the work of the support rib base driving mechanism is adjusted based on the real-time flow, head, efficiency and power of the mixed flow pump, so as to adjust the shape of the flexible guide vane 17, changing the flow area of guide vane channel to adapt to the current flow condition and improving the efficiency of mixed flow pump The present invention is operated by the following steps:

Step 1: Before the mixed flow pump officially starts working, each support rib 8 needs to be adjusted to the position close to the suction surface of the guide vane 11, the angle of each servo motor 7 is "zeroed", and then the support rib 8 is adjusted to one end away from the long strip-shaped hollow groove and away from the guide vane 11, the current corresponding angle of each support rib 8 is recorded, which is the maximum rotation angle of each support rib 8;

Step 2: Carry out angle positioning test of support rib 8: Start the mixed flow pump and adjust the flow condition of the mixed flow pump. When the mixed flow pump operates stably under different flow conditions, the support rib angle adjustment module starts to drive the servo motor 7, slowly increase the rotation angle of the remaining support ribs 8, and record the maximum efficiency value of the mixed flow pump and the corresponding optimal angle of the support ribs 8 into the database during the change of the angle of the support ribs 8; during the adjustment process, keep the angle of the support rib 8 in the first long strip-shaped hollow groove at the inlet unchanged so that it is always close to the suction surface of the blade; during the rotation of other support ribs 8, the rotation angle of each support rib 8 changes in proportion k along the flow direction until the last support rib 8 has the maximum rotation angle, where k is a number greater than 1.

Step 3: After the mixed flow pump is officially operated and stable, the flow condition detection device of the mixed flow pump monitors the flow condition of the mixed flow pump in real time, and the angle adjustment module of the support rib 8 adjusts the angle of each support rib 8 according to the data in the database to adjust it to the optimal angle closest to the flow condition; thereafter, the angle adjustment module of the support rib 8 fine adjusts within ±5° of the optimal angle, and obtains the maximum efficiency value of the mixed flow pump and the corresponding angle of each support rib 8; at the same time, record the data into the database in step 2, so that the mixed flow pump can be adjusted in time when it runs under this flow condition next time; if the mixed flow pump flow condition detection device detects the flow change of the mixed flow pump, carry out real-time fine adjustment according to step 3

The embodiment is only used to illustrate the design ideas and features of the present invention and intended to enable a person skilled in the art to understand the content of the present invention and implement it accordingly. Therefore, any equivalent changes or modifications based on the principles and design ideas revealed by the present invention are within the scope of protection.

What is claimed is:

1. A mixed flow pump with adjustable flow area having a flexible guide vane structure, comprising an impeller hub, an impeller, guide vanes, m flexible guide vanes, and a flexible guide vane adjusting device;

the flexible guide vane adjusting device comprises m groups of support ribs, n support rib bases, n groups of motors, and a number of support ribs in each group is n, and one end of each support rib in the m groups of support ribs is fixedly installed on one of the support rib bases;

each one of the flexible guide vanes are installed behind a suction surface of each guide vane;

n strip-shaped annular grooves are arranged at a root of each guide vane, the strip-shaped annular grooves extend along a circumferential direction on a guide vane hub; each support rib base being annular and arranged and sleeved in a respective strip-shaped annular groove, each support rib having one end fixed on a respective support rib base and extending through one of the strip-shaped annular grooves; and at least one of the group of motors is installed in a gap in a respective support rib base, wherein m is a positive integer greater than 2 and n is a positive integer greater than 5; each flexible guide vane is fixedly installed on each group of support ribs, and each support rib base is driven by the at least one of the group of motors, so as to drive the support ribs to rotate; and each support rib base is driven by different motors to rotate the respective support rib base at a different angle from an adjacent support rib base, thus, a shape of the flexible guide vane is changed.

2. The mixed flow pump with adjustable flow area according to claim 1, wherein each flexible guide vane and a suction surface of each adjacent guide vane fit each other; and a height of each support rib does not exceed a height of the guide vanes.

3. The mixed flow pump with adjustable flow area according to claim 1, wherein a cross section of each support rib is cylindrical, and a cross section diameter is equal to a maximum thickness of each guide vane; and each support rib is provided with a screw hole, the corresponding position of the flexible guide vane is provided with a through hole, and each flexible guide vane is fixed on a respective group of support ribs by screws.

4. The mixed flow pump with adjustable flow area according to claim 1, wherein a groove is arranged on an annular plane on a side of each support rib base, and a first roller is installed in the groove, each groove is in sliding contact between the first roller and an adjacent support rib base.

5. The mixed flow pump with adjustable flow area according to claim 1, wherein multiple grooves are also arranged on an outer circumferential surface of each support rib base, and a second roller is installed inside, each of the second rollers are in rolling contact with an inner wall surface of the guide vane hub and the respective support rib base.

6. The mixed flow pump with adjustable flow area according to claim 1, wherein a number of the strip-shaped annular grooves is the same as that of each group of support ribs, and each of the strip-shaped annular grooves is evenly distributed along a direction from an inlet to an outlet of the guide vane;

a maximum width of the strip-shaped annular groove is not more than twice a cross-sectional diameter of the support rib;

the strip-shaped annular groove at an inlet end of the guide vane is a first strip-shaped annular groove, a minimum circumferential length of the first strip-shaped annular groove is 1.5 times the cross-sectional diameter of the support rib therein, and a maximum circumferential length of each strip-shaped annular groove is 3 times the cross-sectional diameter of each support rib; and the minimum circumferential length of the strip-shaped annular groove between the first strip-shaped annular groove and a guide vane outlet is ½ of a width of a single guide vane channel, and the maximum circumferential length is 0.9 times the width of a single guide vane channel.

7. The mixed flow pump with adjustable flow area according to claim 1, wherein each motor is a servo motor and each is fixed in a square groove inside a filling block located inside each support rib base, each filling block is an annular cylindrical structure, and adjacent filling blocks are in contact through an annular protrusion on one side;

each support rib base and each respective filling block are fixed in an axial direction through a compression ring behind the guide vanes;

the compression ring is provided with a plurality of second through holes evenly spaced along the circumferential direction for fixing by bolts;

a plurality of third through holes are also arranged at a wire slot of a corresponding filling block on the compression ring.

8. A method for adjusting a flow area of the mixed flow pump according to claim 1, comprising the following steps:

step 1: before the mixed flow pump starts working, each support rib is adjusted to a position adjacent to the suction surface of the guide vane, an angle of each servo motor is zeroed, and then each support rib is adjusted to one end away from the strip-shaped annular grooves and away from the guide vanes, a current corresponding angle of each support rib is recorded, which is a maximum rotation angle of each support rib; and step 2: carry out angle positioning test of support rib by starting the mixed flow pump and adjusting a flow condition of the mixed flow pump until the mixed flow pump operates stably under different flow conditions, then the each servo motor is driven so as to slowly increase a rotation angle of the remaining support ribs, and recording a maximum efficiency value of the mixed flow pump and a corresponding optimal angle of the support ribs into a database during a change of the angle of the support ribs; during an adjustment process, keeping the angle of the support rib in a first strip-shaped annular groove at an inlet unchanged so that each group of support ribs is always adjacent to the suction surface of the respective guide vane; during the rotation of other support ribs, the rotation angle of each support rib changes in proportion k along a flow direction until a last support rib has the maximum rotation angle, wherein k is a number greater than 1.

9. The mixed flow pump with adjustable flow area having the flexible guide vane structure according to 1, wherein an inner ring of the support rib base is provided with an internal gear, the motor comprises a servo motor and an external gear, the external gear is installed on an output shaft of the servo motor, and meshes with the internal gear on the support rib base.

* * * * *